United States Patent [19]

Kenchel

[11] 4,007,726

[45] Feb. 15, 1977

[54] FORCED AIR ASSEMBLY FOR SPACE HEATER

[75] Inventor: Thomas F. Kenchel, Huntsville, Ala.

[73] Assignee: Martin Industries, Inc., Huntsville, Ala.

[22] Filed: Feb. 11, 1976

[21] Appl. No.: 657,069

[52] U.S. Cl. ..... 126/67; 126/110 B; 126/50; 165/122

[51] Int. Cl.[2] ..... F24H 3/06

[58] Field of Search ..... 126/67, 58, 114, 117, 126/110 R, 110 AA, 110 B, 110 C, 110 D, 110 E; 165/DIG. 2, 121, 122; 34/232, 160; 98/40 C, 40 N; 415/209; D23/93, 107, 119, 136, 155, 158

[56] References Cited

UNITED STATES PATENTS

| | | | |
|---|---|---|---|
| 2,362,940 | 11/1944 | Skerritt | 165/122 X |
| 2,468,909 | 5/1949 | Yeager et al. | 165/121 X |
| 2,613,663 | 10/1952 | Mitacek et al. | 126/110 B |
| 2,716,405 | 8/1955 | Nelson | 126/67 X |
| 2,742,892 | 4/1956 | Herzer | 126/110 B |
| 2,808,823 | 10/1957 | Snyder et al. | 126/67 X |
| 3,044,460 | 7/1962 | Hoskinson | 126/110 B |

*Primary Examiner*—William F. O'Dea
*Assistant Examiner*—Larry Jones
*Attorney, Agent, or Firm*—C. A. Phillips

[57] ABSTRACT

A forced air assembly for attachment to an otherwise unjacketed space heater consisting of a fan or blower centrally mounted in a relatively thin (height compared with width) channel, the channel being adapted to wrap around varying contours of stoves by virtue of a series of cut-out regions in side walls of the channel. Air is forced through the channel, heated, and flows out of the ends of the channel.

6 Claims, 3 Drawing Figures

FORCED AIR ASSEMBLY FOR SPACE HEATER

BACKGROUND OF THE INVENTION

Over the years, space heaters, typically burning coal or wood, have been manufactured in great numbers and in various sizes and shapes, many ranging from circular to various degrees of curvature. With the event of the energy shortage, people are turning back to the use of these relatively simple heaters; and in addition to the placing back in service of many of them, they are again being manufactured in significant numbers.

A principal problem or deficiency with many of these stoves is that they are unjacketed and provide no means of forced air exchange. Accordingly, the object of this invention is to remedy this by producing a blower assembly which can be simply mounted on most space heaters, regardless of contour and size.

SUMMARY OF THE INVENTION

In accordance with the invention, a heat receiving jacket is constructed of a length of metal channel. The side walls are serrated, enabling the channel to be adjustably curved. An opening is made in the central portion of the channel, to which a fan housing is attached. A motor driven fan is supported by this housing, typically being attached to a screen which would cover the outer end of the housing, and through which air would be drawn in and forced in two directions through the channel, would be heated by the space heater, and the heated air forced out the ends of the channel.

DETAILED DESCRIPTION OF THE DRAWINGS

Figure 3:
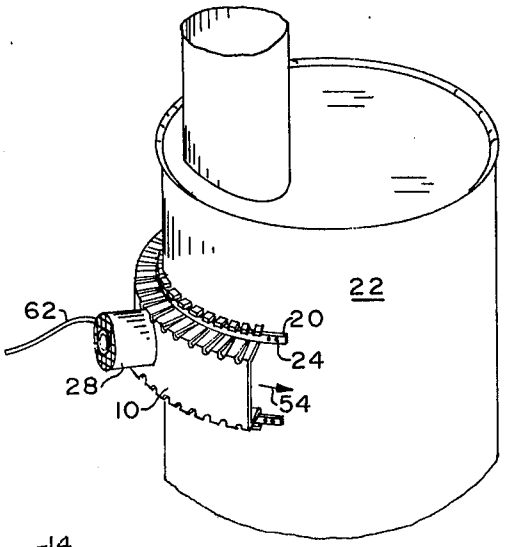
FIG. 3 is a perspective view illustrating the installation of the forced air assembly.
Figure 2:
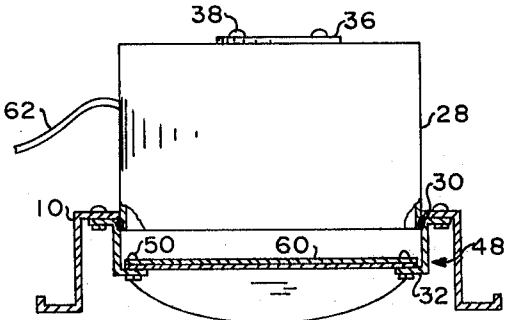
FIG. 2 is a sectional view as seen along lines 2—2 of FIG. 1.
Figure 1:
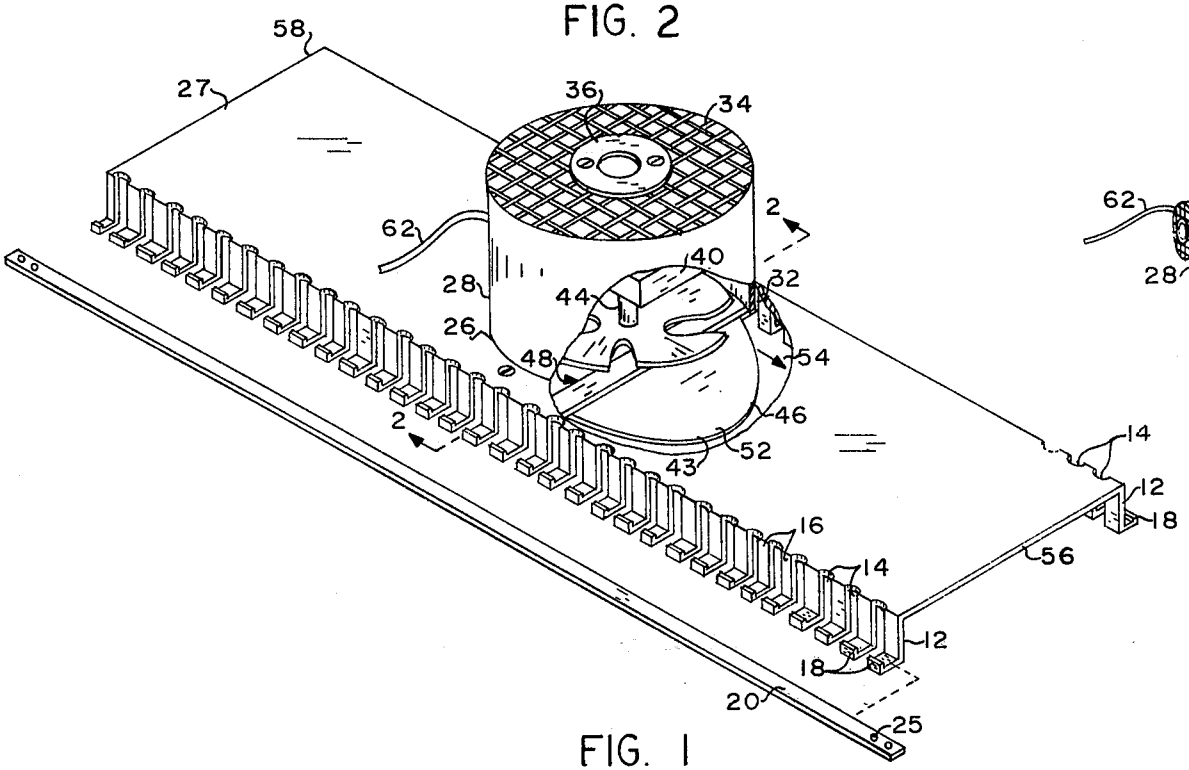
FIG. 1 is a perspective view of the forced air assembly of this invention.

Referring to FIG. 1, channel 10 would typically be constructed of metal of a thickness of 0.024 to 0.035 inch. The height of the channel would typically be 1 to 3 inches; the width of the channel would typically be 6 to 10 inches (the height small compared to width); and the length of the channel would typically be 20 to 30 inches. The side walls 12 have cut-out regions 14, leaving spaced side wall portions 16. The width of the remaining side wall portions are typically 2 to 4 times the width of the openings or serrations. The end regions 18 of side walls 12 are turned out and up to accommodate locking straps 20 which fit over the thus formed bottoms of the turned-out portions and provide means for attaching and locking the assembly to space heater 22, as shown in FIG. 3. Attachment would be by such means as sheet metal screws 24 passing through an opening or openings 25 of straps 20 into holes drilled in stove 22.

A circular opening 26 is centrally located in top 27 of channel 10, and in it is attached fan housing 28, attachment being by screw, rivet, or spot welding 30 (as shown) to support bracket 32, in turn fastened to channel 10. A metal screen material 34 forms an outer end portion of housing 28 (attachment by means not shown), and to it is centrally attached motor mount 36 by fasteners 38. Motor 40 is supported at one end to motor mount 36 (by means not shown). Fan 43 mounts on a conventional shaft 44 of motor 40. Heat radiation shield 46 is interposed between fan 43 and the opposite surface of a stove by means of bracket assembly 48 attached by fasteners 50. It serves to provide heat protection for motor 40, particularly in cases where heater 22 is used without the fan operating. Shield 46 is turned down at each side 52 to enable air flow to be directed by the shield from fan 43 along the direction of arrow 54 to provide air flow in a first direction within channel 10 and out end 56 of channel 10, and is similarly configured to provide air flow into and out of the opposite end 58 of channel 10. Bracket assembly 48 consists of a central cross bracket 60 and side brackets 32 which support cross bracket 60 on a top surface region of channel 10. As stated above, brackets 32 also support fan housing 28.

Typically, fan housing 28 would be four to six inches in length and would be of a diameter just slightly less than the width dimension of channel 10.

When installed on a space heater 22, as shown in FIG. 3, and with power connected to fan motor 40 via electrical cord 62, fan 43 draws air in through fan housing 28, forces it over shield 46 and along the surface of space heater 22 enclosed by channel 10. The exiting air, principally out ends 56 and 58 (some flows out openings 14), is thus heated and directed into the space around heater 22, typically a room of a house. By this arrangement, there will be produced air circulation through the room, generally picking up air from the lower level of the room and forcing it through the heater and out into the room. By means of this invention, space heaters of varying configurations having no other means of effecting forced air circulation can be readily converted to forced hot air heaters, having significantly improved heating capability and efficiency.

What is claimed is:

1. A forced air assembly for a space heater comprising:

an elongated channel having open ends, a top region, and spaced serrated side regions, whereby said channel may be selectively deformed to conform, and be attached to, the curved side wall of a space heater;

a cylindrical housing, open at both ends, attached to and extending outwardly normal to said top region of said channel, and forming with an opening in said top region an air passageway through said channel;

a fan mounted in said housing and oriented to blow air into said channel, which air then passes through said channel and out the ends of the channel when mounted on a said space heater; and means for attaching said channel to a said space heater.

2. A forced air assembly as set forth in claim 1 further comprising a heat shield comprising a plate positioned between said fan and the bottom of said channel where it would engage a space heater, said shield being positioned and configured to permit the passage of air over the top surface of said shield and into said channel while blocking direct heat radiation from a said space heater into said housing and onto said fan.

3. A forced air assembly as set forth in claim 2 wherein said side regions of said channel have turned-out end regions, and said means for attaching said channel to a said space heater comprises first and second elongated straps, each strap being adapted to close over a said turned-out region, and means for attaching said straps to a said space heater.

4. A forced air assembly as set forth in claim 3 wherein an outer end region of said cylindrical housing comprises a screen, said fan comprises a fan blade and a motor driving said blade, and said motor is attached to said screen.

5. A forced air assembly as set forth in claim 4 wherein the width of said channel is of a greater dimension than the height of said channel.

6. A forced air assembly as set forth in claim 5 wherein the length of said channel is 20 to 30 inches, the height of said channel is 1 to 3 inches, and the width of said channel is 6 to 10 inches.

* * * * *